United States Patent [19]

Tresser

[11] Patent Number: 4,614,365

[45] Date of Patent: Sep. 30, 1986

[54] INTEREST-BEARING INSTRUMENT KIT

[76] Inventor: David Tresser, 90 E. 46th St., Brooklyn, N.Y. 11203

[21] Appl. No.: 700,119

[22] Filed: Feb. 11, 1985

[51] Int. Cl.[4] ..... B42D 15/00

[52] U.S. Cl. ..... 283/59; 283/58; 283/73

[58] Field of Search ..... 283/59, 58, 73

[56] References Cited

U.S. PATENT DOCUMENTS

| | | | |
|---|---|---|---|
| 733,054 | 7/1903 | Landing | 283/44 X |
| 967,016 | 8/1910 | Hanzlik | 283/59 |
| 1,141,452 | 6/1915 | Faithfull | 283/59 |
| 1,258,894 | 3/1918 | Hanzlik | 283/59 |
| 1,286,303 | 12/1918 | Hanzlik | 283/59 |
| 1,542,692 | 6/1925 | Gentry et al. | 283/59 X |
| 4,221,326 | 9/1980 | Kandpal | 283/44 X |

*Primary Examiner*—Paul A. Bell

*Attorney, Agent, or Firm*—Handal & Morofsky

[57] ABSTRACT

An interest-bearing financial instrument kit is provided comprising a travelers check having a format for the entry and collection of interest due on the check, and a calculator for the calculation of the interest due on the check. The calculator comprises a first and second flat, circular, planar member concentrically affixed to each other at their centers to allow rotation of each member with respect to each other and having concentrically aligned scales representing the total value of the check relative to the time elapsed from date of purchase to date of redemption, and representing the face value of the check, whereby the second member can be rotated relative to the first member to visually obtain the total value of the travelers check when cashed.

11 Claims, 5 Drawing Figures

INTEREST-BEARING INSTRUMENT KIT

BACKGROUND OF THE INVENTION

People who travel to various parts of the country or outside of the country generally find it necessary to find a means of carrying currency in a safe and secure way. Whether they travel for business or tourist purposes, one of the most common ways of transporting cash or currency on them is through the use of travelers checks. These checks are generally purchased in various face amounts in consideration for a fee paid to the issuer of the checks at the time of their purchase. The transaction usually requires the purchaser to pay for the face amount of the check plus the purchase fee, and to sign and date the checks in the presence of an agent representing the issuer of said checks. Once the checks are properly issued, the purchaser can redeem them at any time and any place in exchange for goods purchased by the proper cashing or redemption procedure of the travelers checks.

Unfortunately, however, the purchaser or consumer of these travelers checks are denied the benefits of having any interest paid to them as a result of the passage of time while the checks are in their possession and the currency in the possession of the issuer. The institution issuing the checks has the distinct advantage of using the consumers' funds for its own purposes, especially if the purchaser of the travelers check does not redeem or cash it for a long period of time. The longer the period of time that the consumer holds the check, the more advantageous it is for the issuing institution because of the corresponding amount of time the institution can utilize the actual currency.

Accordingly, this invention relates to a concept whereby the purchaser of an instrument, such as a travelers check, can obtain interest from the issuing institution on the basis of the amount represented by the instrument in question and the time it is held by the purchaser. This concept, therefore, creates an interest bearing financial instrument that generates and pays interest without the security of a holder of such an instrument to establish an underlying bank account or credit reference of any kind in his or her name.

In order to carry out the concept of the invention, however, the calculation of interest due on such an instrument becomes critical to the instrument's function. For example, in order for a bank, a non-entity bank, a vender of goods or services, or a merchant, or the like, to redeem the value of the instrument, including the interest due, in exchange for currency, an easy and viable method must be made available to the parties concerned for the accurate calculation of the interest due. Thus an apparatus or method must be made available to the consumer and/or entity redeeming the instrument, so that they can easily and reliably calculate the total value of the instrument after a given passage of time. Such a method or apparatus, therefore, becomes an integral part of the invention in order to protect both the consumer or purchaser of the instrument and the person or entity redeeming the instrument, especially where interest rates may vary over a period of time.

The calculation of the interest that becomes due on the instrument is also important if the instrument is to be processed through regular banking channels. Thus, in the case of a travelers check, the amount of interest due at the time of its redemption will be dependent on the rate of interest given at the time of the travelers check's purchase and the amount of time that has transpired up to the point of cashing the travelers check. In order for the check to be processed through the regular banking channels, the correct or proper amount of value must be entered on the check before it can be properly redeemed. In addition, the redeemer or payee's identity must be entered on the travelers check along with the data and countersignature of the purchaser. Once the redeemer or payee has exchanged currency or goods in return for the face value of the check plus the proper amount of interest, and has endorsed the check (in this case on the reverse side), the payee can deposit the check into his or her bank to collect its full value from the issuer. The correct amount of interest calculated, therefore, becomes of paramount importance if the purchaser and payee are to collect the appropriate amount of funds owed them ultimately by the issuer of the travelers checks.

DESCRIPTION OF THE INVENTION

In order to implement the foregoing concept and overcome the problems attendent thereto, an interest-bearing instrument kit or package has been devised whereby all parties to such a financial instrument, which is preferably in the form of an interest-bearing travelers check, can readily calculate the interest, and therefore the total value of said financial instrument, at any given point in time after its purchase or issuance. Accordingly, an interest-bearing instrument kit is provided, comprising an interest-bearing instrument and a calculator for calculating the interest accumulated on said instrument, (a) said interest-bearing instrument comprising
  1. a plurality of transverse lines printed on the face of said instrument for the entry of:
     (i) an issue or purchase date;
     (ii) the value of the instrument when issued or purchased;
     (iii) the value of the instrument when cashed;
     (iv) the identity of the drawee of the instrument;
     (v) the identity of the payee of the instrument;
     (vi) the signature and countersignature of the purchaser of said instrument; and
     (vii) the date when the instrument is cashed;
  2. a plurality of columns on the reverse side of said instrument for the entry of:
     (i) the issue or purchase date;
     (ii) the date when the instrument is cashed;
     (iii) the time elapsed from the date of issuance to the date of cashing of said instrument;
     (vi) the face value of said instrument;
     (v) the total value of said instrument at the time it is cashed; and
     (vi) an endorsement of said instrument; and (b) said calculator comprising a first and second flat, circular, planar member concentrically affixed to each other at their centers in a manner to allow rotation of each planar member with respect to the other; wherein
  1. said first circular planar member has at least two concentrically aligned scales contained thereon, the scales representing the total value of the interest-bearing instrument relative to the amount of time elapsed from the date of issue or purchase of said instrument to the date of cashing of said instrument; and wherein 2. said second planar member has at least one scale representing the face value of the instrument when issued or purchased, in alignment with the concentrically aligned scale of said first planar member, whereby the second member can be rotated relative to the first member to visually obtain the total value of said instrument when cashed.

The face of the interest-bearing instrument may optionally contain a transverse line or space for the entry of the purchaser's domicile and/or social security number for the reporting of interest that is paid out to the purchaser, to the government. In addition, a transverse line or lines, or space, can be provided for the identity of the location where the instrument was issued, this in the event that the issuer of such an instrument has more than one geographical place of business. This would especially be the case if the instrument is in the preferred form of a travelers check.

With regard to the reverse side of the instrument, the columns can be characterized in greater detail by setting forth, in column form, the twelve months of the year, with a space for the entry of the year next to each month in the event that it becomes desirable to calculate the amount of interest due based on the passage of total elapsed months. In this manner, the month and year when the instrument was purchased and redeemed can be readily checked to allow for a quick tally of the passage of time. The total number of months elapsed can be entered in the next corresponding column to provide the basis upon which the interest can be calculated, and thus the total value of the instrument. It should be noted that any number of designs and formats can be used on the reverse side of the check for the recordation and calculation of the amount of elapsed time from the date of purchase to the date of redemption, without departing from the scope of the concept herein.

The calculator portion of the kit, as mentioned hereinbefore, has two circular members fixed to each other at their centers to allow rotation of one with respect to the other. These members, which have scales printed thereon, are designed to be hand-held and portable, and form part of the kit that is issued when a consumer purchases the interest-bearing instruments. The members are generally made of a rigid construction, which may be flexible or inflexible, and can be opaque or translucent depending on the manner of the scale display.

The first member contains at least two scales, preferably printed thereon, which represent the total value of a given face value of an instrument relative to the amount of time elapsed between the date of purchase and date of redemption. The second member represents the face value domination of the instrument. The total number of face value denominations represented on the calculator will generally depend on the total size of each of the members and the size print that is used for displaying the various numbers. Obviously, the more face value denominations represented, the bigger the calculator must be. In the case of interest-bearing travelers checks, the number of face values represented on the second member will usually be the popular denominations used in the local currency, which in the United States of America will be five, ten, twenty, fifty, one hundred, five hundred and one thousand dollars, although any combination of these demoninations, and other foreign currency denominations, can be represented on the calculator.

The amount of interest given on a particular face-valued instrument will be a function of time and the prevailing interest rate. The time expressed in the scale on the first planar member can be set forth in terms of days, weeks, months or years, although for practical purposes in the case of travelers checks, the time elapsed will be expressed in terms of weeks or months. It should be noted that as an alternative to the total value of the instrument set forth on the first planar member, the actual amount of interest on a given face-value denomination can be scaled in its place. In that event, a lined column or space can be provided on the reverse side of the instrument for the entry of the appropriate interest accrued relative to the passage of time. In this fashion, the amount of interest can be added to the face-value of the travelers check to calculate its total value.

PREFERRED EMBODIMENT

The preferred embodiment of an interest-bearing instrument kit is best represented by the accompanying drawings.

Figure 1:
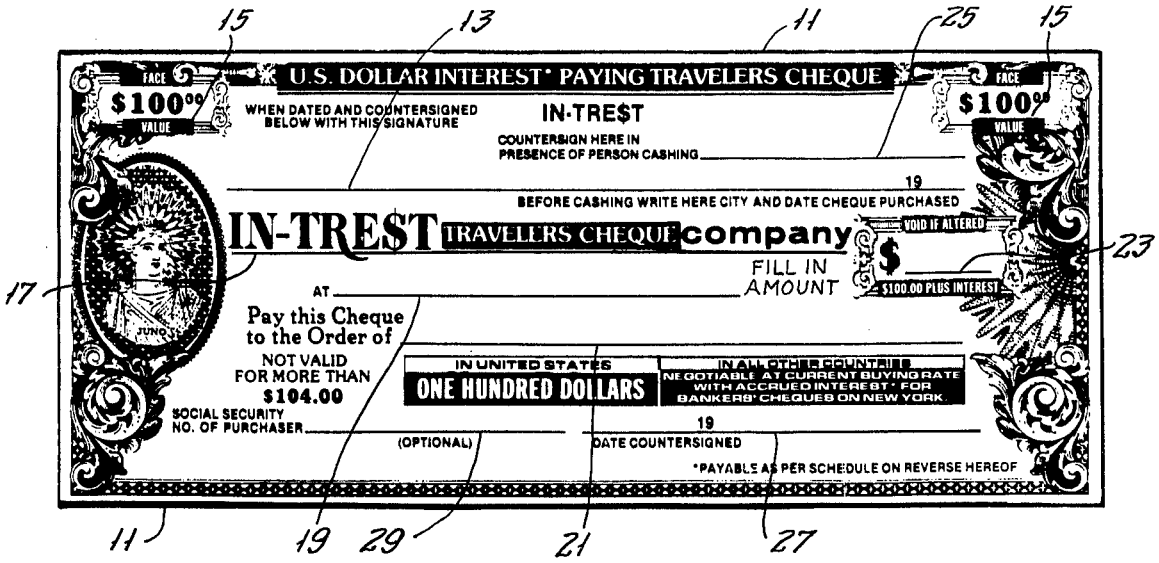
FIG. 1 is a top plan view of the front of an interest-bearing travelers check having a face value of one hundred dollars.

Referring to the drawings, 11 generally designates an interest bearing travelers check according to the kit described in the invention herein. The travelers check 11 comprises a transverse line 13 for the entry of the place where the travelers check was purchased and the date of purchase. Line 15 underlies a space wherein the face value of the check, in this case one hundred dollars, is printed. Lines 17 and 19 define the identity of the drawer of the check and the drawer's geographical location, respectively. The check 11 shown in FIG. 1 describes "INTEREST TRAVELERS CHEQUE COMPANY" as the drawer or entity from whom the funds will ultimately be drawn after the check is redeemed and processed through normal banking channels. Line 2 sets forth a space wherein the identity of the payee is entered at the time when the check 11 is to be cashed or redeemed. The space for the entry of the total value of check 11, that is, the face value of $100.00 plus the interest accrued, is defined by transverse line 23. Line 25 defines a space for the signature of the purchaser at the time of the check's purchase, and line 27 defines a similar space for the purchaser's countersignature and date of countersignature, which will generally be the date of cashing the check 11. Lastly, line 29 underlies a space for the entry of the purchaser's social security number.

Figure 2:
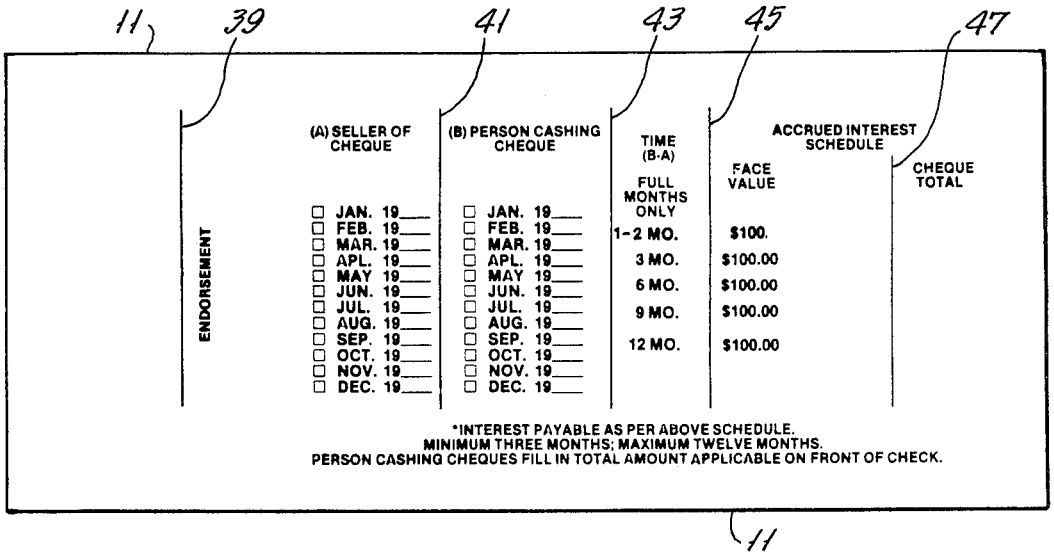
FIG. 2 is top plan view of the reverse side of the interest-bearing travelers check shown in FIG. 1.

The reverse side of check 11 is shown in FIG. 2 and generally contains a set of vertically drawn lines 39, 41, 43, and 47 for the entry of the following information. The vertical line designated as 39 defines a space to its left for the endorsement of the payee of the travelers check after the check is cashed. The two spaces defined by vertical lines 39, 41, and 43 contain a vertical listing of the months and year for the respective entry of the month and year when the check is sold and cashed. This is accomplished by simply having the issuer or seller of the travelers check check the box to the left of the month and writing in the year when the check is purchased. In similar fashion, the person cashing the check designates the month and year when the check is redeemed. The time elapsed is easily calculated by summarizing the full number of months from the date of purchase to the date of redemption, and entering that number in the space defined by lines 43 and 45. The space defined by lines 45 and 47 contains the face value of the check. With the passage of time calculated and the face value of the check given, the total value of the check can be determined from the calculator 61 (shown in FIG. 3) and entered into the appropriate space to the right of line 47, and into the space above line 23 on the front side of check 11.

Figures 3, 3A:
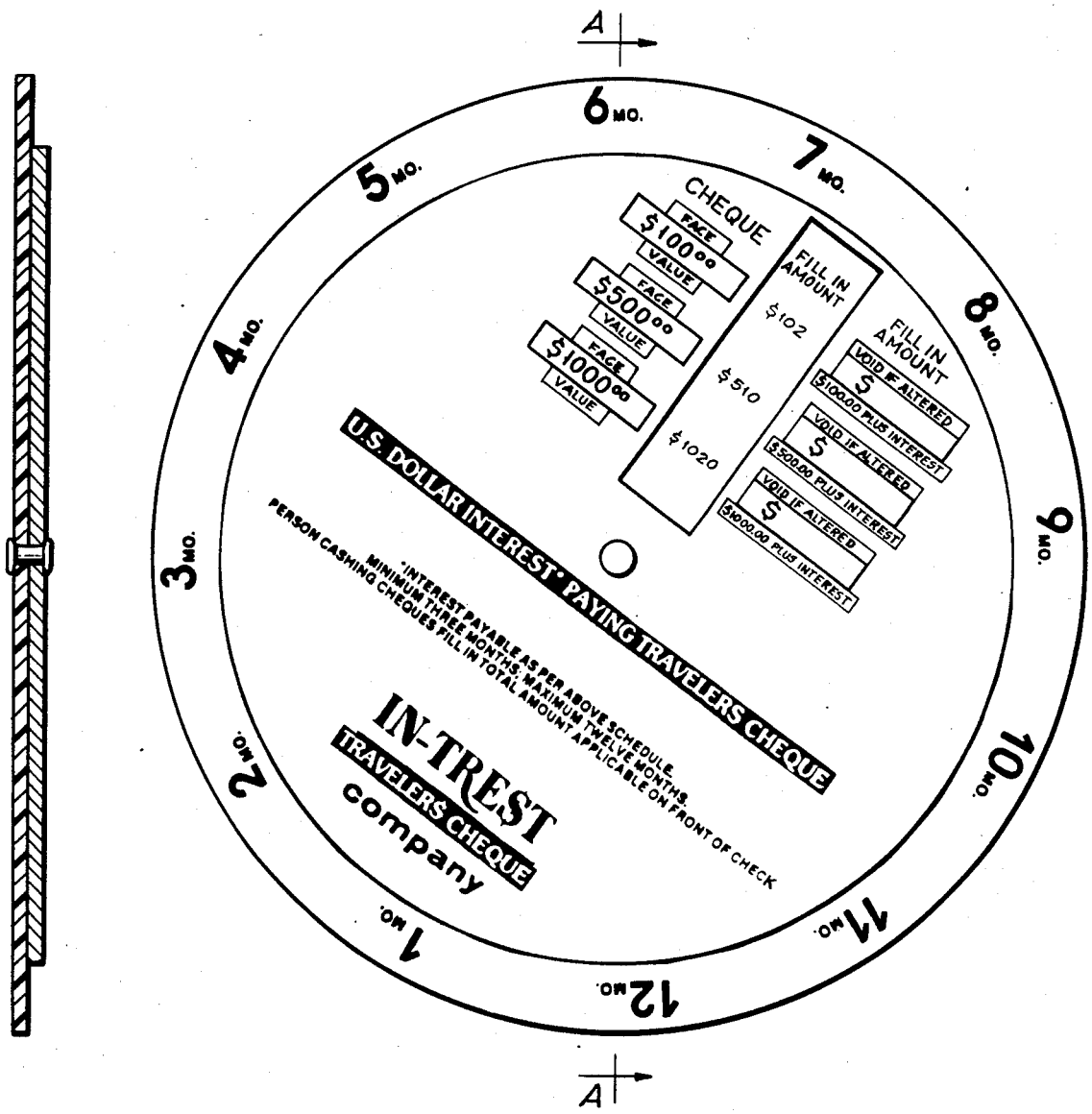
FIG. 3 is an enlarged top plan view of a portable, hand-held calculator constructed in accordance with the present invention.
FIG. 3A is an enlarged vertical cross-sectional view taken along the line A—A of FIG. 3.

The calculator, according to the invention, is shown in FIG. 3. The calculator 61 is composed of two flat, circular members 63 and 65, in this case made of a cardboard construction, concentrically joined together at their centers by means of a metal rivet 67 to allow rotation of each member with respect to the other. Members 63 and 65 can be made of any suitable material, such as a rigid plastic material having a degree of flexibility, and can also be either transparent or opaque.

Figure 4:
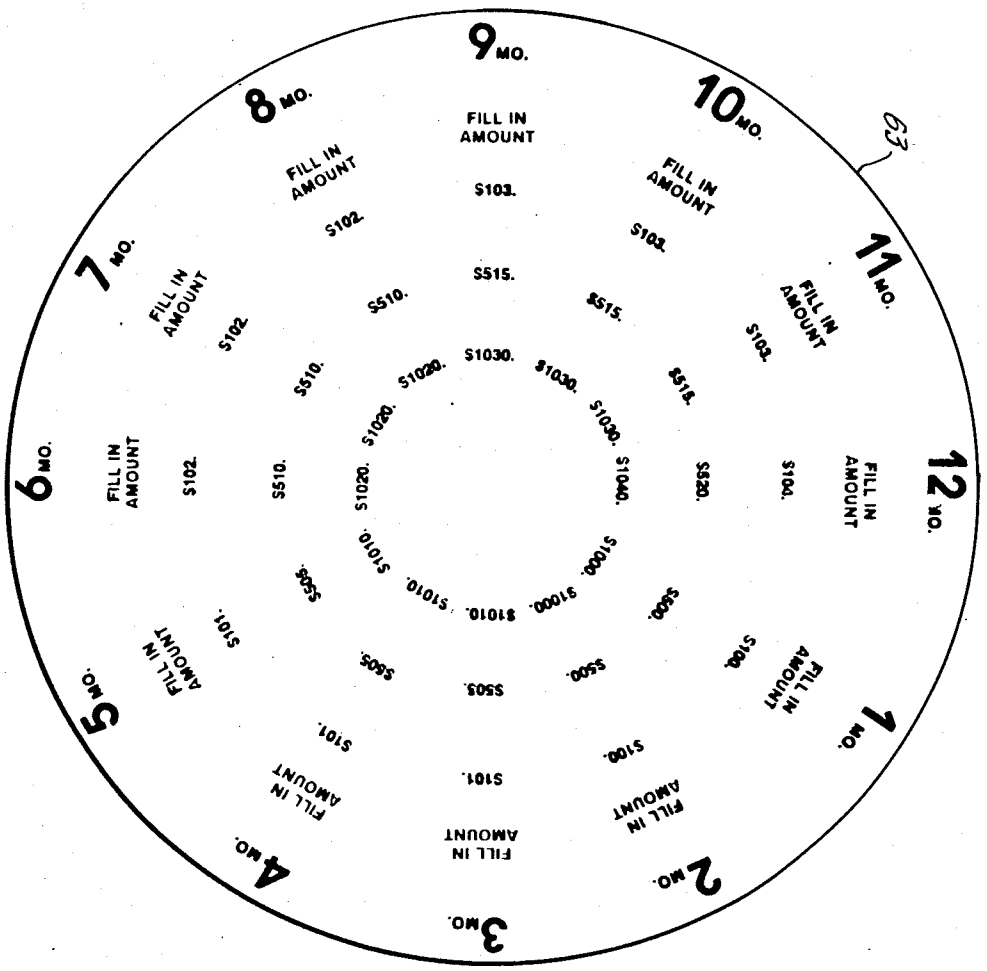
FIG. 4 is an enlarged top plan view of the first member of the calculator shown in FIG. 3.

The bottom member 63, shown in FIG. 4, carries numerical scales of time elapsed in months relative to the total value of the interest-bearing check having face value denominations of $100, $500 and $1000 amounts. As will be seen from FIGS. 3 and 3A, bottom member 63 is larger in diameter than top member 65 to accomodate complete visibility of the time (in months) scale on bottom member 63. While this arrangement is a preferred embodiment, it will be appreciated that both members can be of equal diameter provided that the rectangular opening in top member 65 is enlarged to accomodate the outer time scale of bottom member 63. As an alternative, both top and bottom members 63 and 65 can be of equal size if the top member 65 is made of a transparent material, such as plastic.

Figure 5:
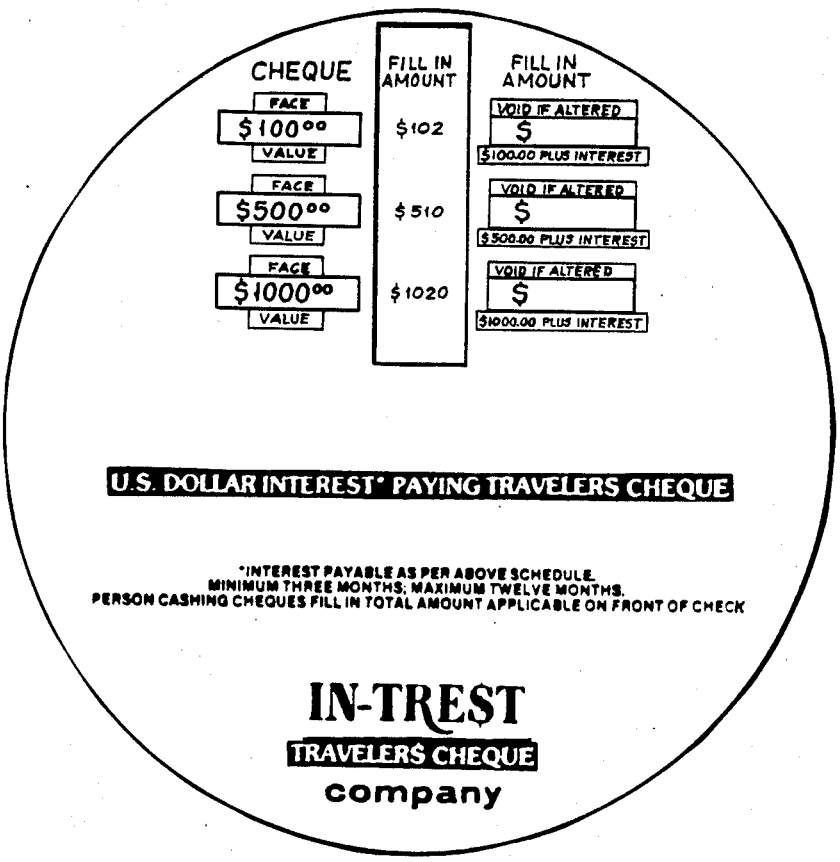
FIG. 5 is an enlarged top plan view of the second member of the calculator shown in FIG. 3.

Top member 65, illustrated in FIG. 5, has the face-value check denominations of $100, $500 and $1000 printed thereon next to a rectangular opening in member 65 to allow alignment thereof with the appropriate total value of the travelers check scale printed on bottom member 3 for any given month. Thus, as illustrated in FIG. 3 by way of example, the total value of a travelers check having a face value of $100 and held for seven complete months is $102.00. As will be apparent, top member 65 can be rotated to any month-passage-of-time for a quick and instant visual determination of the total value of the travelers check.

It is to be noted that different scales can be used if the interest alone is to be calculated. Thus, scales can be provided on bottom member 63 to give the amount of interest for a given face value of the travelers check.

Depending on the local economy, different scales can also be provided on member 63 to reflect a change or revision in interest rates. The outer most time scale on lower member 63 can also be reflected in terms of days, weeks, months, or even years, depending on the nature and type of interest-bearing instrument utilized.

Having thus described an interest-bearing instrument kit, what is claimed is:

1. An interest-bearing instrument kit comprising an interest-bearing instrument and a calculator for calculating the interest accumulated on said instrument, a. said interest-bearing instrument comprising
   1. an indication of the value of the instrument when issued or purchased;
   2. a plurality of transverse lines printed on the face of said instrument for the entry of:
      i. an issue or purchase date;
      ii. the value of the instrument when cashed;
      iii. the identity of the drawee of the instrument;
      iv. the identity of the payee of the instrument
      v. the signature and countersignature of the purchase of said instrument; and
      vi. the date when the instrument is cashed; and
   3. a plurality of columns on the reverse side of said instrument for the entry of:
      i. the issue or purchase date;
      ii. the date when the instrument is cashed;
      iii. the time elapsed from the time of issuance to the date of cashing of said instrument;
      iv. the face value of said instrument;
      v. the total value of said instrument at the time it is cashed; and
      vi. an endorsement of said instrument; and b. said calculator comprising first and second flat, circular planar members concentrically affixed to each other at their centers in a manner to allow rotation of each planar member with respect to the other; wherein
   1. said first circular planar member has at least two concentrically aligned scales contained thereon, the scales representing the total value of the interest-bearing instrument relative to the amount of time elapsed from the date of issue or purchase of said instrument to the date of cashing of said instrument; and wherein
   2. said second planar member has at least one scale representing the face value of the instrument when issued or purchased, in alignment with the concentrically aligned scale of said first planar member, whereby the second member can be totaled relative to the first member to visually obtain the total value of said instrument when cashed.

2. The interest-bearing instrument kit according to claim 1, wherein the instrument indicates it is a travelers check.

3. The interest-bearing instrument kit according to claim 2, wherein the face of the travelers check additionally contains a transverse line for the entry of the purchaser's domicile.

4. The interest-bearing instrument kit according to claim 2, wherein the face of the travelers check additionally contains a transverse line for the entry of the purchaser's social security number.

5. The interest-bearing instrument kit according to claim 2, wherein the face of the travelers check additionally contains a line for the entry of the identity of the location where the travelers check was issued.

6. The interest-bearing instrument kit according to claim 2, wherein the face value of the travelers check is either five, ten, twenty, fifty, one hundred, five hundred or one thousand dollars.

7. The interest-bearing instrument kit according to claim 2, wherein the reverse side of the travelers check has an additional column for the entry of the appropriate amount of interest accrued relative to the passage of time from the date of purchase to the date of redemption.

8. The interest bearing instrument kit according to claim 7, wherein the columns and markings on the reverse side of the travelers check correspond to the scales on said calculator.

9. The interest-bearing instrument kit according to claim 2, wherein the face value denominations represented on each planar member is one hundred, five hundred or one thousand dollars.

10. The interest-bearing instrument kit according to claim 2, wherein the time expressed on the first planar member is given in months.

11. The interest bearing instrument kit according to claim 1, wherein the reverse side includes a column of months and years each with a box next to it to indicate the date of cashing by checking of the box and entering of the year.

* * * * *